US009789581B2

(12) United States Patent
Cloutier

(10) Patent No.: US 9,789,581 B2
(45) Date of Patent: Oct. 17, 2017

(54) BORE FINISHING TOOL

(75) Inventor: Daniel R. Cloutier, Clive, IA (US)

(73) Assignee: Sunnen Products Company, St. Louis, MO (US)

( * ) Notice: Subject to any disclaimer, the term of this patent is extended or adjusted under 35 U.S.C. 154(b) by 1206 days.

(21) Appl. No.: 13/876,666

(22) PCT Filed: Oct. 18, 2011

(86) PCT No.: PCT/US2011/056755
§ 371 (c)(1),
(2), (4) Date: Mar. 28, 2013

(87) PCT Pub. No.: WO2012/054516
PCT Pub. Date: Apr. 26, 2012

(65) Prior Publication Data

US 2013/0309950 A1 Nov. 21, 2013

Related U.S. Application Data

(60) Provisional application No. 61/394,019, filed on Oct. 18, 2010.

(51) Int. Cl.

| | |
|---|---|
| ***B24B 33/02*** | (2006.01) |
| ***B24B 33/08*** | (2006.01) |
| ***B24D 9/02*** | (2006.01) |
| ***B24B 57/02*** | (2006.01) |
| ***B24B 37/11*** | (2012.01) |
| ***B24B 37/02*** | (2012.01) |

(52) U.S. Cl.
CPC ..... *B24B 37/11* (2013.01); *B24B 33/02* (2013.01); *B24B 33/08* (2013.01); *B24B 33/083* (2013.01); *B24B 33/085* (2013.01); *B24B 37/02* (2013.01); *B24B 57/02* (2013.01); *B24D 9/02* (2013.01)

(58) Field of Classification Search
CPC ..... B24B 33/00; B24B 33/02; B24B 33/08; B24B 33/082; B24B 33/083; B24B 33/085; B24B 57/02; B24D 9/02
USPC ..... 451/470, 472, 478, 487, 504
See application file for complete search history.

(56) References Cited

U.S. PATENT DOCUMENTS 1,960,555 A * 5/1934 Sims ..... B24D 9/02 451/496
4,199,903 A * 4/1980 Fitzpatrick ..... B24B 33/085 451/471

(Continued)

*Primary Examiner* — Eileen Morgan
(74) *Attorney, Agent, or Firm* — Matthews Edwards LLC

(57) ABSTRACT

A bore finishing tool has an arbor with a tapered outer circumferential surface and a sleeve over the arbor having a tapered inner circumferential surface cooperatively disposed in surface to surface overlaying relation to at least a substantial portion of the tapered outer circumferential surface of the arbor. The sleeve is adjustably movable relative to the arbor for expanding a diametrical extent of the sleeve and has a plurality of internal material relief features at circumferentially spaced locations in the tapered inner circumferential surface extending partially through the sleeve so as to reduce a level of force required for expanding the diametrical extent of the sleeve. Exemplary material relief features include flutes and fractures. The sleeve can also include an external retraction feature enabling application of a retraction force by an external device for reducing the diametrical extent.

28 Claims, 7 Drawing Sheets

(56) References Cited

U.S. PATENT DOCUMENTS

| | | | | | |
|---|---|---|---|---|---|
| 4,223,485 | A * | 9/1980 | Largeteau | B24B 33/085 | 451/478 |
| 4,253,279 | A * | 3/1981 | Althen | B24B 33/085 | 451/478 |
| 4,291,504 | A * | 9/1981 | Fitzpatrick | B24B 33/085 | 451/22 |
| 4,424,648 | A | 1/1984 | Largeteau | | |
| 5,022,196 | A * | 6/1991 | Schimweg | B24B 33/085 | 451/470 |
| 5,371,978 | A * | 12/1994 | Higashikawa | B24B 33/08 | 451/155 |
| 5,482,498 | A * | 1/1996 | Higashikawa | B24B 33/08 | 451/155 |
| 6,139,414 | A * | 10/2000 | Domanski | B24B 33/085 | 451/471 |
| 2002/0037688 | A1 * | 3/2002 | Higashikawa | B24B 33/08 | 451/180 |

* cited by examiner

BORE FINISHING TOOL

This application is submitted under 35 U.S.C. 371 claiming priority to PCT/US2011/56755, filed Oct. 18, 2011, which application claims the benefit of U.S. Provisional Application No. 61/394,019, filed Oct. 18, 2010.

TECHNICAL FIELD

The invention relates generally to a bore finishing tool, and more particularly, that includes internal features at a tapered interface between an outer sleeve and an inner arbor, to reduce the force necessary to expand and retract the sleeve by relative movement of the sleeve and arbor along the interface, and which can reduce internal stresses within the sleeve and possibility of damage.

BACKGROUND ART

U.S. Provisional Application No. 61/394,019, filed Oct. 18, 2010, is incorporated herein by reference in its entirety.

Bore finishing, which for the purposes here focuses on lapping which achieves super fine finishes, and also honing for fine finishes, typically utilizes an abrasive for removing material from the surface of a bore to achieve a desired bore size and finish on the bore surface. The manner of achieving bore finishing of concern utilizes a sleeve, referred to as a lapping sleeve for lapping, having a cylindrical or substantially cylindrical outer surface that acts on a workpiece bore with the abrasive. For honing the abrasive is fixed to the sleeve surface, and it will be desirable to have a means to adjust the diameter of the honing surface for achieving a certain bore size and to compensate for abrasive wear. For lapping, the abrasive is loose, in the form of a compound with a fluid carrier such as a paste. Because the abrasive is loose, it can be replenished or replaced, but will cause wear to the lap surface, and because of that and that the bore being lapped will increase in diameter during the lapping operation, it is desirable to have a means to adjust the diameter of the lapping sleeve.

Adjusting the diameter of the outer sleeve of a bore finishing tool such as a lapping sleeve is typically accomplished by having a tapered internal interface between the sleeve and an arbor or wedge received in the sleeve. In particular, an internal circumferential surface on the sleeve, is disposed about, and in mating relation to, a tapered outer surface on the arbor or wedge. The sleeve is cut or slit lengthwise, helically, or such so that it will expand diametrically when the sleeve is displaced axially relative to the arbor in the direction of divergence of the tapered surface of the arbor, that is toward the larger diameter end of the taper of the arbor.

The typical lapping sleeve, therefore, has a C-shaped cross section. The wall thickness of this section is necessarily larger at one end than the other, that is, at the converging end, due to the taper of the internal surface. The force required to expand the lap is the mathematical integration of the force required to open this C-shaped section over the entire length of the sleeve. It is easy to see that the greatest resistance to opening this sleeve (i.e. expanding it diametrically) is to be found at the end with the greatest wall thickness.

In most lapping operations, expansion of the lapping sleeve is done manually, often with a hammer blow to the thick-walled end of the sleeve. Such an impact is often necessary to overcome the significant force of opening the C-shaped cross section. Sometimes expansion is accomplished by means of screw thread on the lapping arbor which has the advantage of providing a more controlled force. But this force is typically applied slowly which can result in a small bulge in the lapping sleeve due to the high frictional forces between the sleeve and arbor. This bulge constitutes a degradation of the cylindricity of the lapping surface that can adversely affect the cylindricity of the bore being lapped. This deformation due to high expansion forces and friction can also be present when the sleeve is expanded by means of a hammer blow.

Very little has been done to change the basic design of slit-sleeved lapping tools that expand by means of mating with a tapered arbor or wedge. Reference, Largeteau U.S. Pat. Nos. 4,223,485 and 4,424,648 which describe a lapping sleeve that is made easier to expand while retaining a cylindrical outer surface by means of longitudinal slots cut through the wall. However, a disadvantage is that there is no single slot cut from one end of the sleeve to the other, and thus a multitude of such slots are required to give the sleeve expansion capability. At each slot some amount of lapping surface is lost, which in most lapping operations will result in a greater rate of tool wear. Furthermore, although most lapping operations generate very low amounts of torque between the sleeve and workpiece bore, some applications generate more torque even if only momentarily. Being cut all the way through in multiple locations, the sleeve would be ill-suited to resist any significant torque without the addition of some keyed features.

Lapping sleeves must also be periodically retracted, usually after one bore has been lapped and another of the same starting size must be lapped. Retraction is accomplished by applying the same large force to the sleeve but in the opposite direction. This force is applied at the end of the lapping sleeve, but at the thin-walled end of the sleeve. At this very thin cross section, a problem that can occur is that a force sufficient to retract the sleeve can cause high stresses, approaching or exceeding the yield point of the sleeve material. It has been observed that, after several applications of this retraction force, the sleeve may be visibly deformed in this location. In many cases this deformation will also degrade the cylindricity of the lapping sleeve and subsequently degrade the resulting cylindricity that can be achieved with the lapping tool.

As another disadvantage of known lapping tools for applications wherein cycle time and productivity is of concern, is that the known bore lapping tools require the lapping compound to be applied externally to the lapping surface, and time is required prior to commencement of the lapping operation, or during the process, to apply lapping compound.

Thus, what is sought is an improved sleeve type bore finishing tool, particularly for lapping or honing, that reduces the force to diametrically expand and retract the sleeve so as to be less likely to cause a permanent deformation thereof, and which overcomes one or more of the other shortcomings and disadvantages set forth above.

SUMMARY OF THE INVENTION

What is disclosed is an improved sleeve type bore finishing tool, particularly for lapping or honing, that reduces the force to diametrically expand and retract the sleeve so as to be less likely to cause a permanent deformation thereof, and which overcomes one or more of the other shortcomings and limitations set forth above.

According to a preferred aspect, the invention resides in a lapping sleeve designed to reduce the force to expand and retract the sleeve and designed to provide for a retraction feature that is less likely to cause a permanent deformation of the sleeve.

According to another preferred aspect of the invention, the sleeve has a tapered interface with the internal arbor or wedge, particularly, a tapered inner circumferential surface cooperatively disposed in surface to surface overlaying relation to at least a substantial portion of the tapered outer circumferential surface of the arbor. The sleeve is adjustably movable relative to the arbor for expanding a diametrical extent of the sleeve and has a plurality of internal material relief features at circumferentially spaced locations in the tapered inner circumferential surface extending partially through the sleeve so as to reduce the level of force required for expanding the diametrical extent of the sleeve, while still providing sufficient surface contact and holding strength within the sleeve for retaining it in a set position on the arbor when subject to torques to be exerted by rotation and forces from the reciprocating movement of the tool in contact with a bore surface while performing surface finishing operations such as lapping or honing. Exemplary material relief features include flutes and fractures, and the number, size and configuration of the material relief features for a particular application will be selected based on the parameters of the application, particularly, anticipated torque and force levels to be generated by rotation and stroking in contact with the surface of a bore being finished.

According to another preferred aspect of the invention, the lapping tool is optionally configured to deliver the lapping compound through the tool itself, to reduce or eliminate time required to apply lapping compound before the lapping process is commenced, or during the lapping process. A supply of the lapping compound is stored in a reservoir within the tool or on the lapping machine, and a conduit is provided through the tool to the outer surface of the lapping sleeve. The lapping compound is delivered through the conduit to the outer surface by a displacement or pressure applied in a controlled fashion by means of the lapping machine.

According to still another preferred aspect of the invention, the outer surface of the lapping sleeve can include a lead in taper, having a free end of reduced diameter, to facilitate insertion of the tool in tight fitting bores.

DETAILED DESCRIPTION OF THE INVENTION

Figure 1:
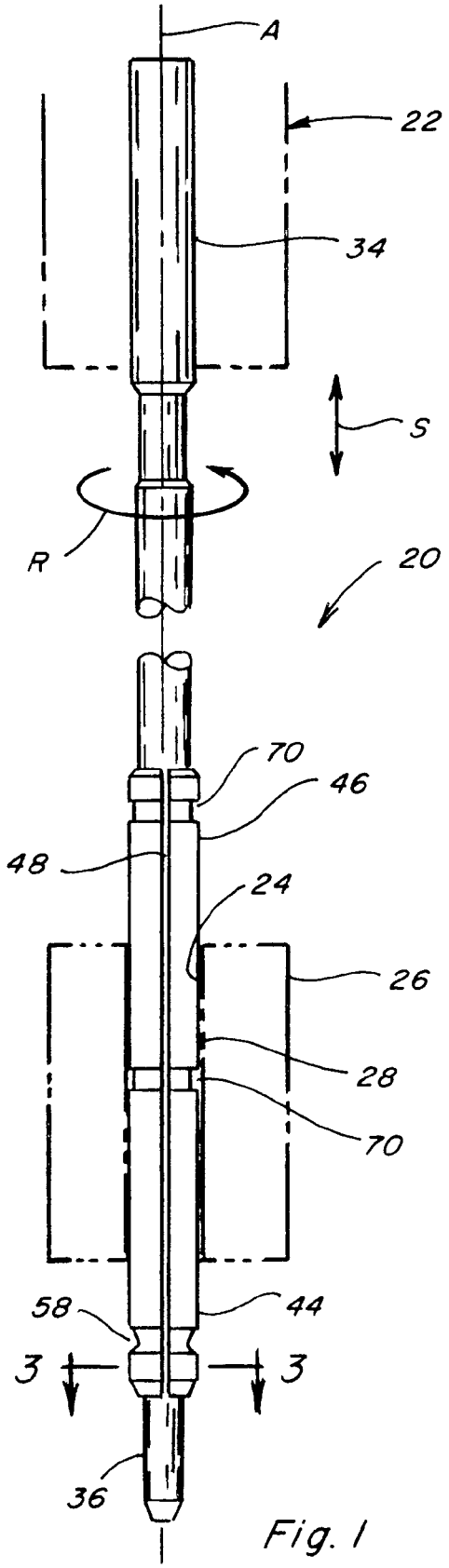
FIG. 1 is a side view of a bore finishing tool of the invention, which is a representative lapping tool, shown supported in a spindle of a bore finishing machine illustrated schematically, and in operative position within a bore of a representative workpiece to be lapped also illustrated schematically.

Referring now to the figures, in FIG. 1 a lapping tool 20 constructed and operable according to the teachings of the invention is shown, supported by a spindle 22 of a bore finishing machine, and in operative position within a bore 24 of a workpiece 26 to be finished. Generally, and operation, spindle 22 will rotate tool 20, as denoted by arrow R, about a rotational axis A therethrough, while reciprocatingly stroking tool 20 relative to the workpiece, as denoted by arrow S, in the well-known manner. Here, the bore finishing operation is a lapping operation, which utilizes loose abrasives carried in a compound with a paste-like fluid, coating an outer circumferential lapping surface 28 of tool 20, for lapping an inner circumferential surface of workpiece 26 extending about and defining bore 24. Alternatively, or additionally, it should be noted that workpiece 26 could be rotated and/or reciprocatingly stroked relative to tool 20, if desired. Also alternatively, tool 20 is representative of a honing tool having a coating of abrasive particles attached to surface 28 and operable for honing a workpiece bore surface as the tool and workpiece are relatively rotated and reciprocated.

Figure 2:
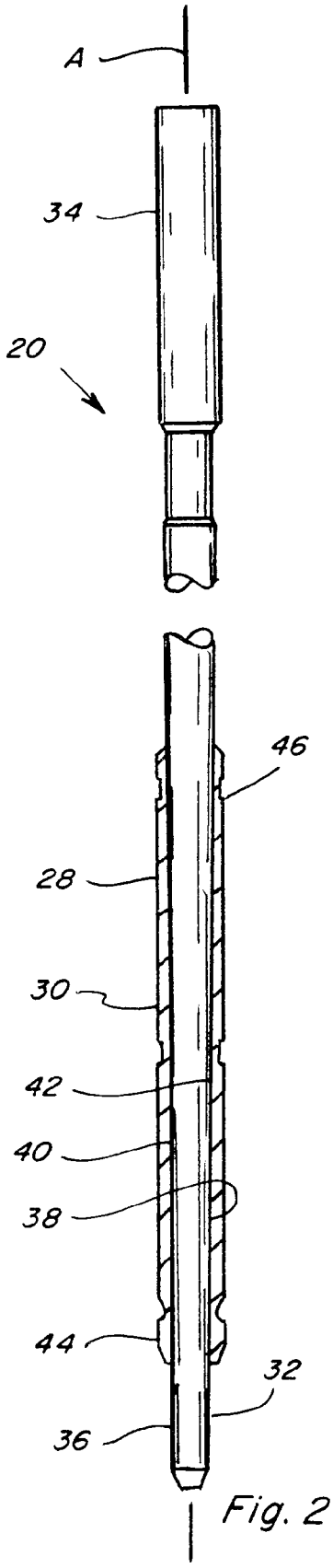
FIG. 2 is a another side view of the tool of FIG. 1, showing a lapping sleeve thereof in cross section to show an internal tapered interface between the sleeve and an arbor of the tool.
Figure 3:
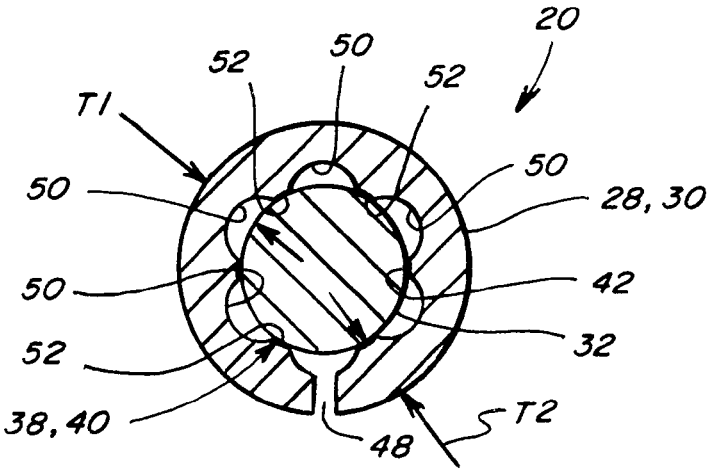
FIG. 3 is a sectional view of the tool of the invention, taken along line 3-3 of FIG. 1, illustrating one embodiment of internal material relief features of the sleeve.

Referring also to FIGS. 2 and 3, internal aspects of lapping tool 20 are shown. Lapping tool 20 includes an outer lapping sleeve 30 including outer circumferential lapping surface 28, sleeve 30 being disposed about and carried on a lapping arbor 32 which is attached to spindle 22. More particularly, lapping arbor 32 is an elongate member having a mounting end 34 which attaches to the spindle, and a longitudinally opposite free end 36 that carries lapping sleeve 30. Sleeve 30 is held on free end 36 of arbor 32 by an internal tapered interface 38 including a tapered outer circumferential surface 40 on arbor 32 which here extends divergingly or increases in diameter toward mounting end 34, and a mating tapered inner circumferential surface 42 on sleeve 30 which extends divergingly or increases in diameter in the same direction, toward an end 44 of sleeve 30. As a result, end 44 of sleeve 30 has a greater wall thickness and thus is the thicker end of the sleeve, compared to an opposite end 46 of the sleeve, lapping surface 28 on the outside of the sleeve being cylindrical shaped.

To be prepared for a surface finishing operation, lapping sleeve 30 will be forced over arbor 32 to a longitudinal position so as to be diametrically expanded to impart a desired diameter to lapping surface 28 and to retain the sleeve on the arbor, as discussed above. Because of the taper of inner circumferential surface 42 of sleeve 30, end 44 of sleeve 30 is the thicker walled end and thus will require greater force to diametrically expand compared to opposite end 46 having the lesser wall thickness. To reduce the force required to expand sleeve 30, it preferably includes at least one cut 48 lengthwise, straight or helical, to create an open circular cross section at every location along the length of the sleeve.

Figure 4:
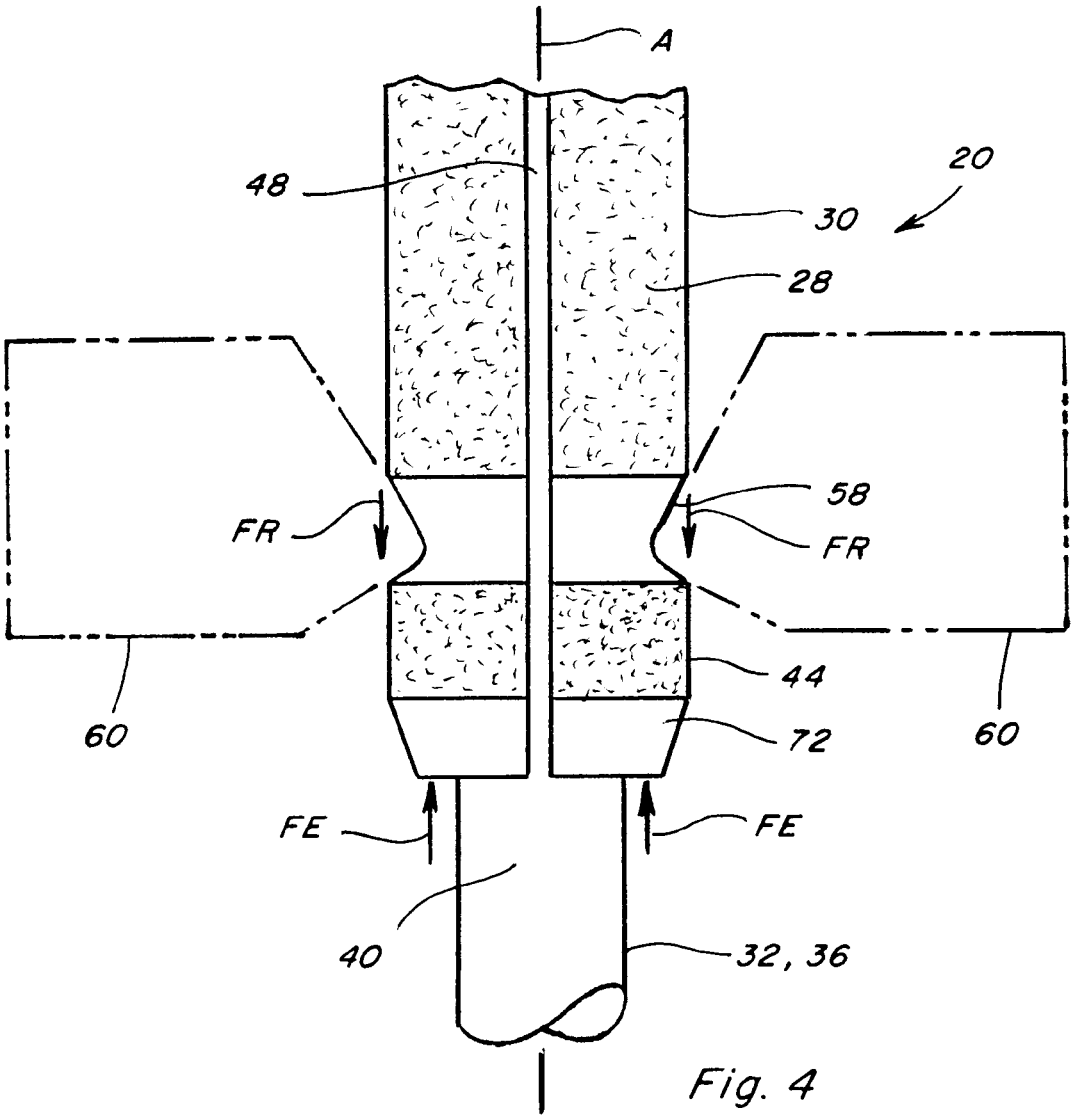
FIG. 4 is a fragmentary side view of the tool, illustrated engaged by apparatus of the invention for moving the sleeve along the arbor.

Referring also to FIG. 4, sleeve 30 will be expanded by application of an expansion force FE against thick-walled end 44 in the direction of divergence of the tapered surfaces, that is, parallel to rotational axis A, either externally or by a mechanism integral with the lapping arbor (not shown) which causes the lapping sleeve to be moved axially along arbor 32 which results in a diametrical expansion of the lapping sleeve. The thick-walled end 44 of lapping sleeve 30 would typically create the largest portion of the resistance to this expansion force. However, to further reduce the force required, according to the invention, internal material relief features are formed in inner circumferential surface 42. Referring more particularly to FIG. 3, here, the relief features comprise curved flutes 50 cut into sleeve 30 at angularly spaced locations about arbor 32. Flutes 50 serve to effectively reduce the wall thickness of sleeve 30 in the locations of the flutes, as denoted by thickness T1, compared to the thickness at locations between the flutes, as denoted by thickness T2, so that the expansion of the sleeve diametrically is accomplished with less force. The shape and number of flutes 50 may vary depending on tool size and convenient manufacturing process. The rounded shape shown in FIG. 3 may be preferred as it creates minimal stress concentrations in the material of sleeve 30, but other shapes may be suitable as well. The size and spacing of flutes 50 must be such that some minimal portions or lands 52 of tapered surface 42 remain between the flutes for contacting tapered surface 40 of arbor 32. Flutes 50 are generally parallel to the axis of the sleeve, and rotational axis A, although they may be helical, if desired.

Figure 5:
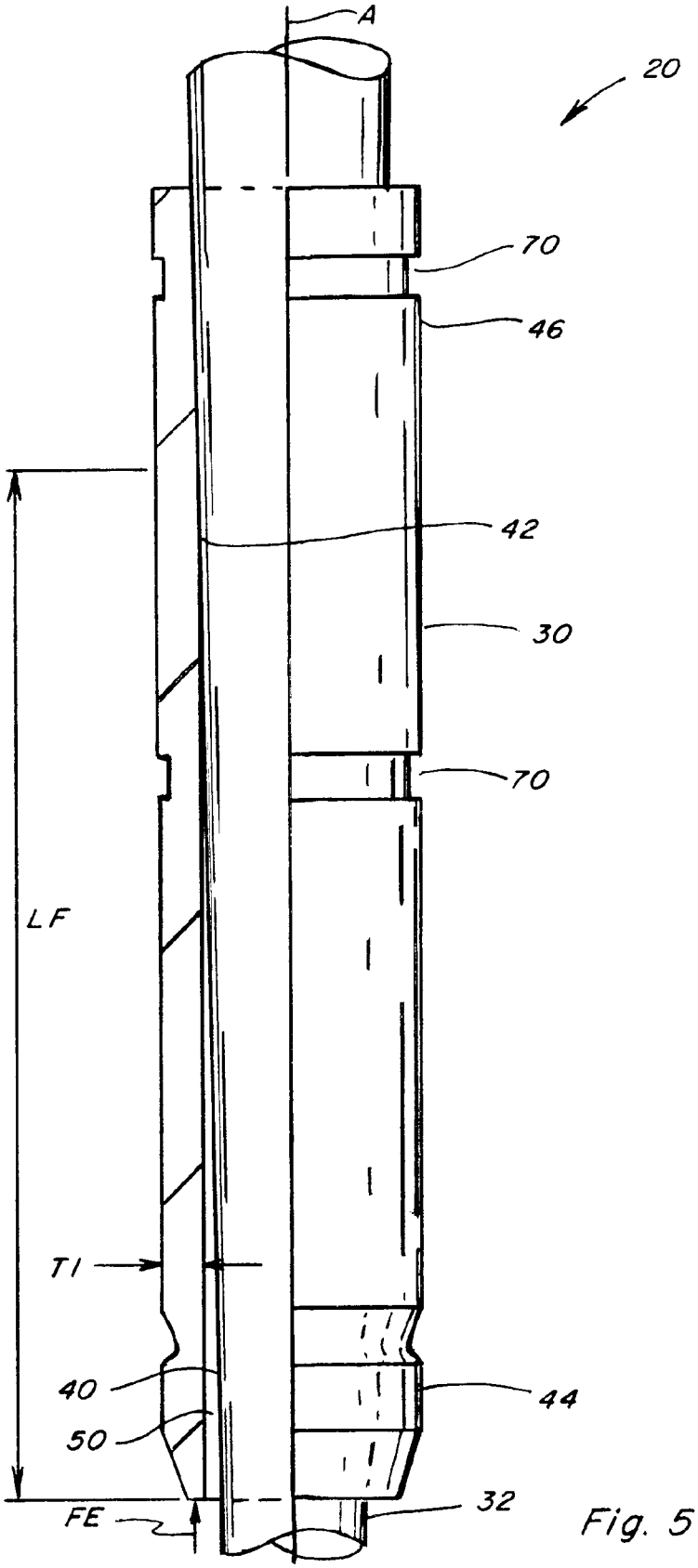
FIG. 5 is an enlarged fragmentary side view of a tool of the invention, in partial cross-section illustrating another embodiment of an internal material relief feature of the inventions.

Additionally, referring also to FIG. 5, flutes 50 do not necessarily need to be present over the full length of sleeve 30, as denoted by the limited length LF of representative flute 50, which extends only part of the length of sleeve 30 from end 44 toward end 46. This can be achieved by using an extrusion for forming sleeve 30 that does not extend to the minimal inner diametrical extent of end 46. Also, for some applications, the thin-walled end of the sleeve may not necessarily benefit from the presence of flutes or other material relief features of the invention, as a result of its thinness. As an advantage, since flutes 50 strategically weaken sleeve 30 thereby reducing the required expansion force FE for expanding the sleeve, it has been found that the sleeve will have little or no tendency to bulge at some axial location as a result of application of the expansion force to the thick-walled end of the sleeve. This is in contrast to known non-fluted sleeve designs which have been observed to be subject to such a bulging effect, which has been found to degrade cylindricity of the sleeve which may be transferred to the workpiece bore during the lapping process. In testing, some sleeves like sleeve 30 of the invention have been found to expand in a very slightly non-cylindrical fashion due to being pushed open at discrete locations, but this non-cylindricity would be in the form of very slight out-of-roundness. This slight out-of-roundness is not transmitted to the workpiece bore by virtue of the spindle rotation. Also with the continual wear of the typical lapping sleeve, any slight out-of-round condition on the sleeve surface will disappear quickly in use.

Figure 6:
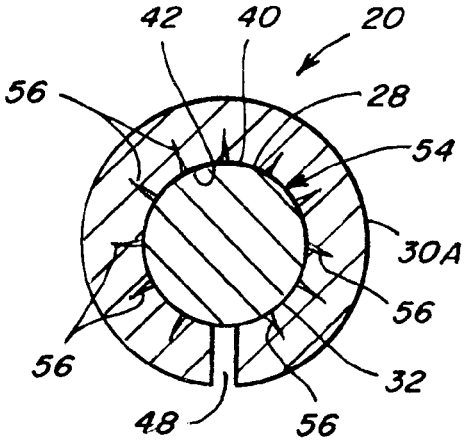
FIG. 6 is a sectional view of a tool of the invention, illustrating another embodiment of internal material relief features of the invention.

Referring also to FIG. 6, tool 20 is shown including a lapping sleeve 30 and a lapping arbor 32, having another embodiment of an internal tapered interface 54 constructed and operable according to the invention. Here, arbor 32 has the same tapered outer circumferential surface 40 as interface 38 discussed above, but tapered inner circumferential surface 42 includes material relief features comprising radially outwardly extending cracks or fractures 56 at angularly spaced locations therearound, which extend only partially through the sleeve from surface 42 toward lapping surface 28, to reduce the expansion force required for expanding the sleeve about arbor 32. The number, depth, and length of the fractures can be selected to provide the desired expansion force characteristics for a particular application. As a non-limiting example, fractures 56 can extend the length of sleeve 30, or can have a length similar to length LF denoted in FIG. 5, as desired or required for a particular application. As a manner of manufacture, fractures 56 can be induced in a sleeve 30 by deliberately over expanding the sleeve in a controlled fashion and then forcing the sleeve back to its original dimensions by some means, so that the fractures are of the desired controlled, predetermined extent prior to first use of the tool. Although cracks or fractures can propagate with use, it is contemplated that this method of generating the internal relief features could have an advantage in lower manufacturing cost, and better consistency in structure and effect compared to cracks that develop in a tool from expansion during actual use.

Figure 7:
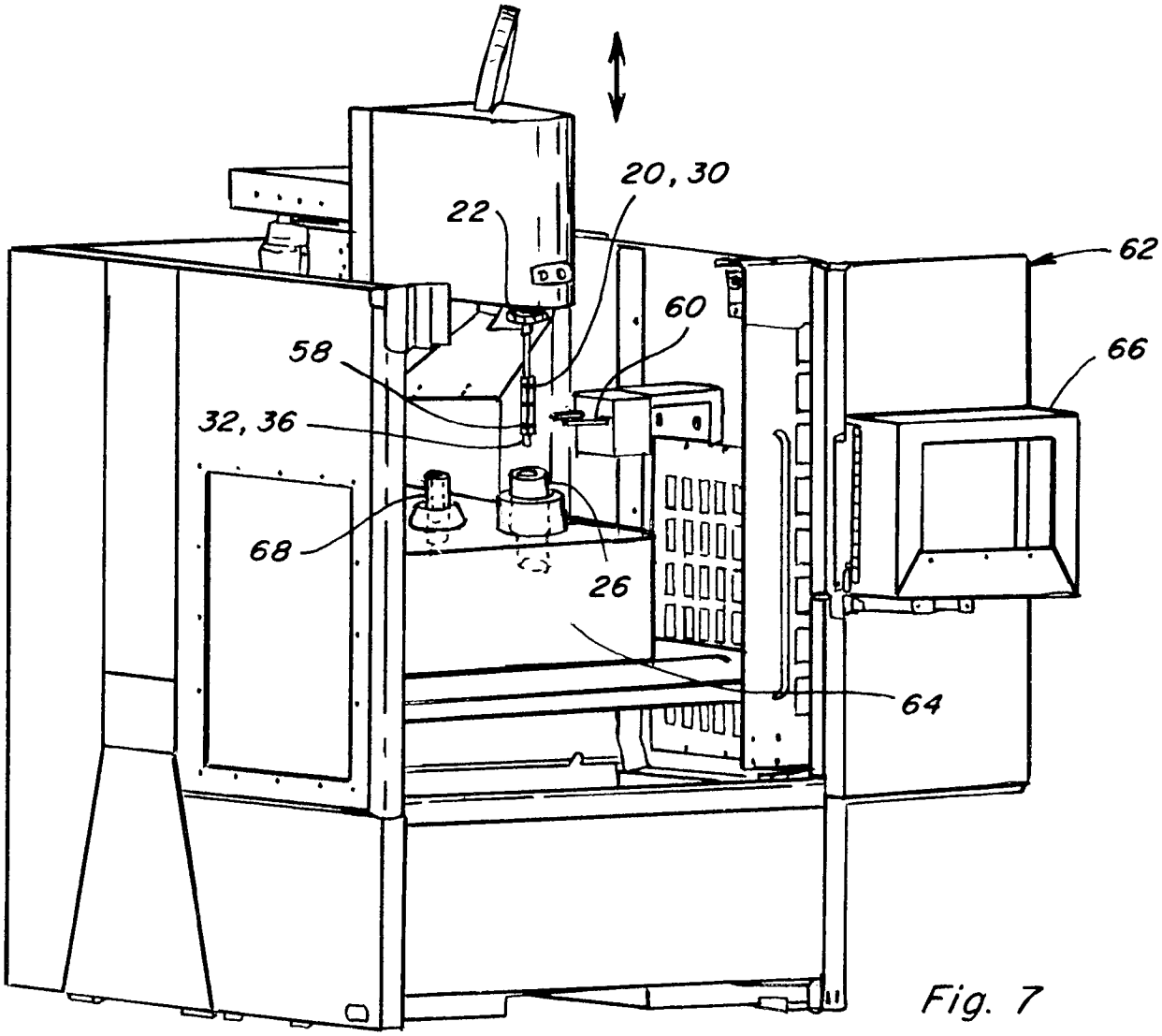
FIG. 7 is a perspective view of a representative bore finishing machine, including a tool of the invention supported in a spindle of the machine, ready for performing a bore finishing operation on a bore of a workpiece, and showing apparatus of the invention for adjusting a diameter of the tool.

Referring more particularly to FIGS. 1 and 4, and also FIG. 7, a lapping sleeve 30 is shown also including a retraction feature 58 near thick-walled end 44 of the sleeve. In these figures feature 58 is recessed into lapping surface 28 and comprises a deep groove or grooves, which can be engaged by some external apparatus configured and operable for applying a retraction force against the sleeve in the direction of convergence of the tapered surfaces for moving the sleeve relative to the arbor in a controlled manner in that direction, for reducing the diametrical extent of the sleeve to a desired extent. Here retraction feature 58 comprises a gripper/collet device 60 (FIGS. 4 and 7), including a pair of rigid prongs or fingers spaced apart for cooperative receipt in the groove or grooves about the sleeve. Retraction feature 58 can be machine controlled, in the case of a lapping machine, denoted by representative bore finishing or lapping machine 62 in FIG. 7, or it can be a handheld device in the case of a manual lapping operation. In either instance, the retraction force FR (FIG. 4) is applied to sleeve 30 in the direction of convergence of the internal tapered surfaces to move the sleeve axially relative to the lapping arbor toward the smaller diameter end thereof, to diametrically retract the lapping sleeve to the desired extent. This serves to apply the retraction force to the sleeve at the location where the resistance to motion is greatest or near greatest, i.e. thick-walled end 44. In contrast, existing lapping tools are retracted by apply a force at the thin-walled end which can require a greater impact which in time can permanently deform the lap at the thin-walled end. Applying this force to the thin-walled end, which in long laps can be a significant distance from the tighter end, can also result in an undesirable bulging of the lapping sleeve. The present invention avoids this by applying the retraction force at the location where the sleeve is tightest on the arbor. The retraction feature need not be a groove as shown in the figure. Slots that can be engaged by pins or any such feature that can be engaged at the thick-walled end of the sleeve are also contemplated according to the invention.

Further referring to FIG. 7, a bore finishing machine such as machine 62, can include a gripper/collet device 60 at a convenient location, such as on or in connection with a table 64 or other structure movable relative to a spindle 22 or other element of machine 62 holding tool 20, for instance next to a fixture holding a workpiece 26, such that the table can be used to automatically move device 60 into contact with retraction feature 58 and the spindle and/or table moved as required to apply the retraction force FR to achieve desired retraction of the sleeve, for instance under automatic control of a controller 66 of the machine. Machine 62 can also include an adjusting collet 68 on or in connection with table 64, having a bore configured and positioned to receive the free end of arbor 32, but not the end of sleeve 30, such that a shoulder or edge of collet 68 will contact the lower end of the sleeve, and spindle 22 can be moved (here downwardly) to apply the expansion force FE (here upwardly) against the sleeve, in the manner illustrated in FIG. 4, which can also be an automatic process suitably controlled, for instance by controller 66 of machine 62. Here, it should be understood that machines such as machine 62 will typically have a table 64 movable in two perpendicular directions in a plane such as the horizontal plane, and that spindle 22 of the machine will be movable in a perpendicular direction to that plane, here, vertically, to enable achieving all of the movements needed to automatically position the tool and devices to apply respective forces FE and FR.

As an additional feature, lapping sleeve 30 may contain optional external grooves 70 which may act as reservoirs of lapping compound and/or otherwise benefit the lapping process. When the lap is to be used in a machine that will automatically insert the lapping tool into the workpiece bore, a lead-in taper 72 (FIG. 4) on the sleeve can be provided.

Figure 8:
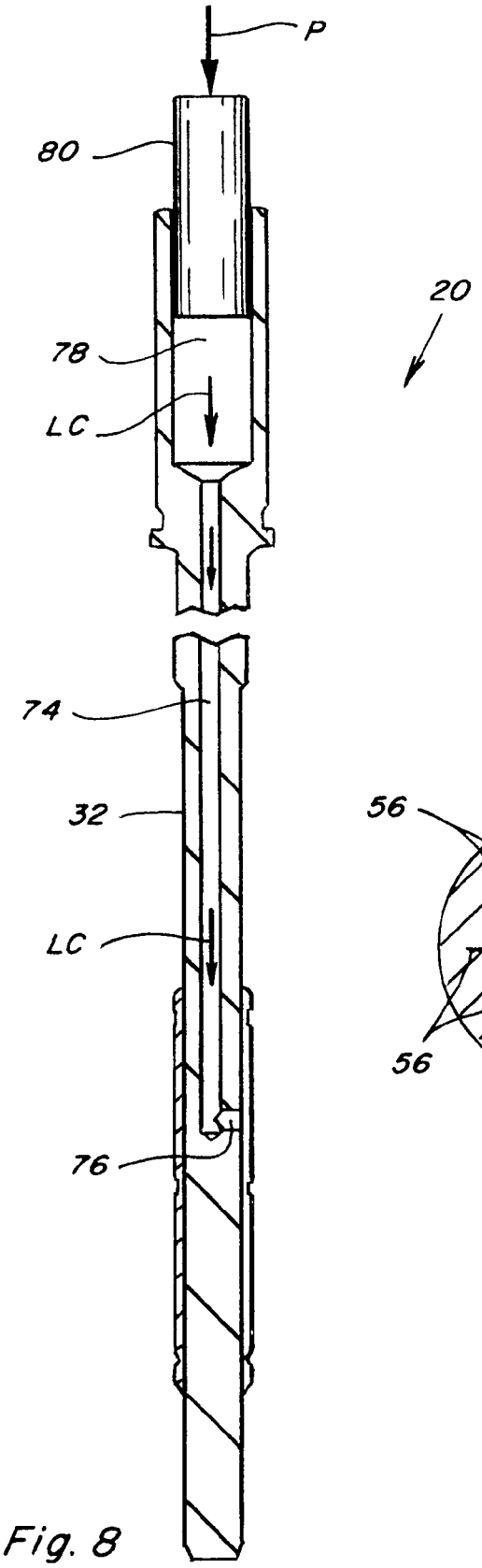
FIG. 8 is a sectional view of the tool of the invention, showing optional apparatus for delivering lapping compound to a surface of the lapping sleeve of the tool.
Figure 9:
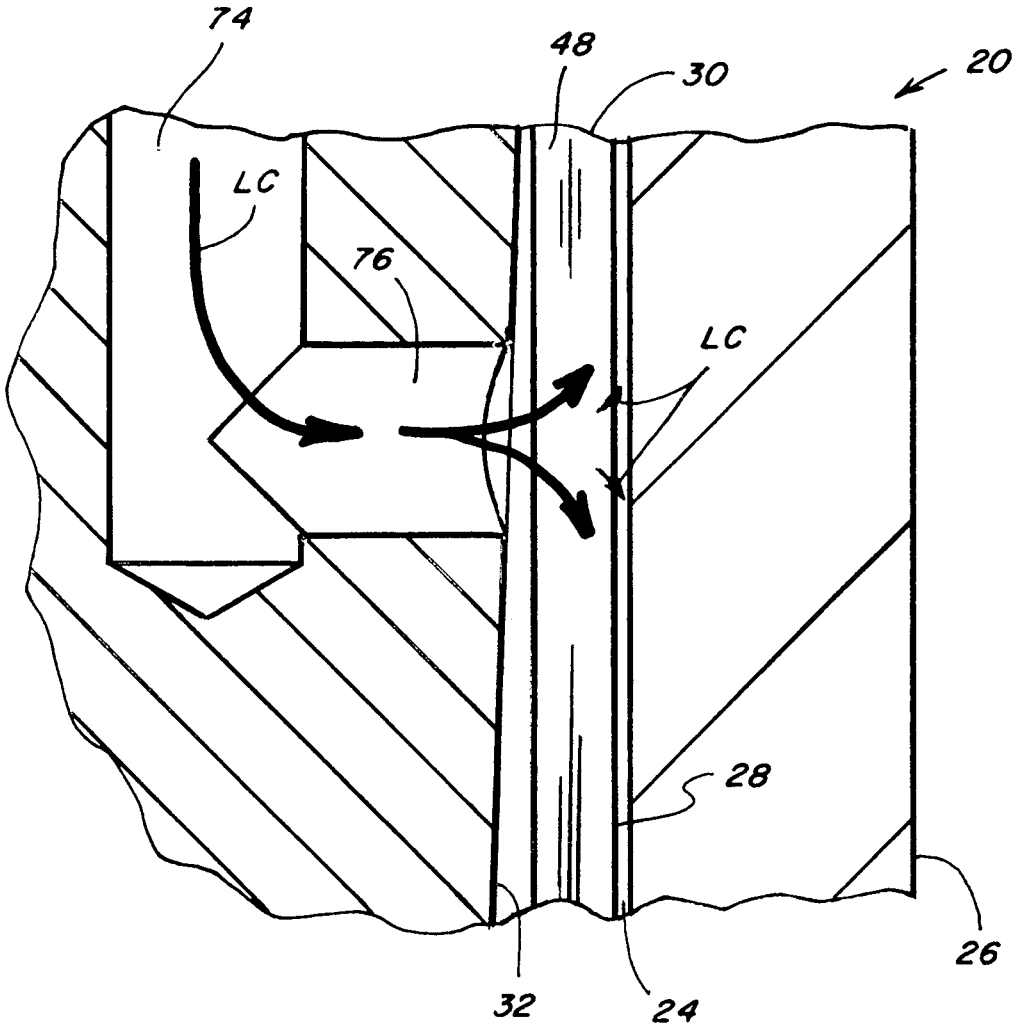
FIG. 9 is an enlarged fragmentary sectional view of the tool of FIG. 8, shown in a bore of a workpiece.

As another aspect of the invention, referring also to FIGS. 8 and 9, tool 20 can be constructed so that the lapping arbor 32 contains an internal passage 74 for the delivery of lapping compound to lapping surface 28 of sleeve 30, as denoted by arrows LC. The compound can be delivered through an exit port or ports 76 aligned with cut 48 through sleeve 30 or other such feature so that the compound will travel to lapping surface 28 of the sleeve. If in a bore of a workpiece such as bore 24 of workpiece 26, the compound will thus be delivered to the interface between the lapping surface and the bore surface for immediate distribution and use. Several means are envisioned for delivery of lapping compound through passage 74. In one embodiment, the tool would contain a small reservoir 78 of lapping compound and have an integral piston 80 for applying a displacement or pressure P to move the compound into the passage. The lapping machine could automatically apply either a controlled displacement for the dispensing of a precise amount of lapping compound at intervals determined by the lapping machine control, e.g., controller 66, or alternately a controlled amount of pressure could be applied for a period of time to dispense the lapping compound. In another embodiment the reservoir and piston would be integral to the lapping machine spindle, e.g., spindle 22 of machine 62 (FIG. 7) which could allow for a larger reservoir.

The embodiments above assume that the lapping compound is a semi-solid or thick liquid substance capable of retaining its location in the passage and reservoir until a displacement or pressure is applied. In some cases, the lapping compound may be a more liquid slurry. For those applications, the lapping machine could deliver a continuous flow of the lapping compound in much the same manner as typical through-the-spindle coolant is delivered in a variety of machine tools that provide such a feature.

Figure 10:
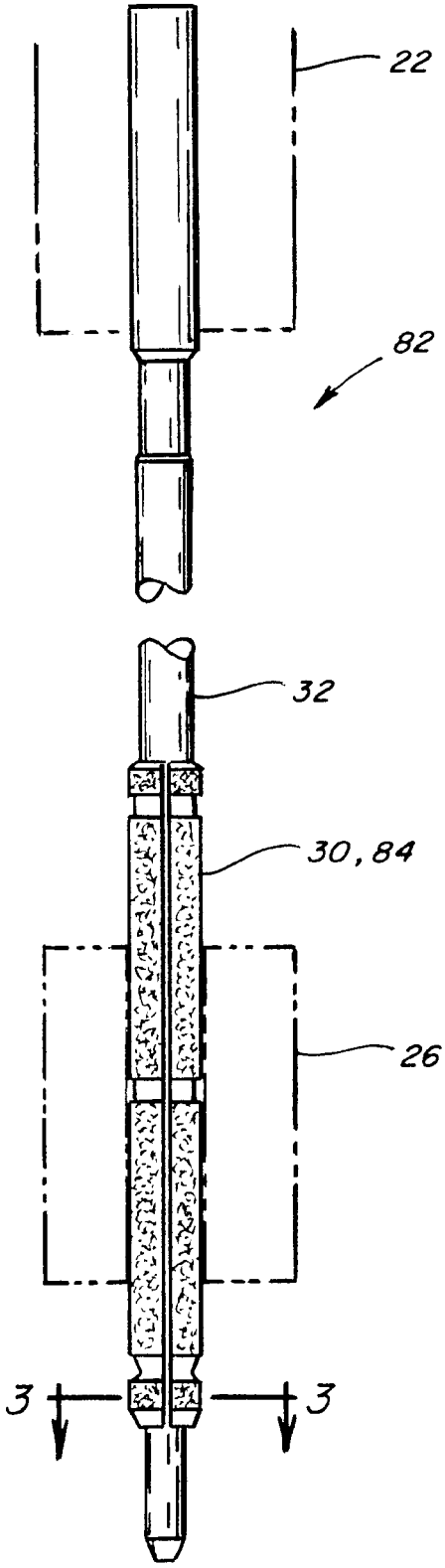
FIG. 10 is a side view of a honing tool including a sleeve incorporating features of the invention.

Referring also to FIG. 10, a honing tool 82 constructed and operable according to the teachings of the invention is shown, supported by a spindle 22 of a bore finishing machine, and in operative position within a bore of a workpiece 26 to be finished. Generally, and operation, spindle 22 will rotate tool 82 about a rotational axis therethrough, while reciprocatingly stroking tool 82 relative to the workpiece, in the above described, well-known manner. Here, the bore finishing operation is a honing operation, which utilizes a fixed abrasive coating 84 on the outer surface of a sleeve 30 of tool 82, for honing an inner circumferential surface of workpiece 26. Tool 82 can include the expansion capabilities and features of tool 20 explained above, including internal material relief features comprising flutes 50 (FIG. 3), or fractures 56 (FIG. 6), on a tapered inner circumferential surface of sleeve 30 as explained above.

In light of all the foregoing, it should thus be apparent to those skilled in the art that there has been shown and described a novel IMPROVED BORE FINISHING TOOL. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A bore finishing tool, comprising an arbor having a mounting end configured for mounting to a spindle of a bore finishing machine, an opposite free end, and a tapered outer circumferential surface extending about the arbor between the mounting end and the free end;

a sleeve having a tapered inner circumferential surface cooperatively disposed in surface to surface overlaying relation to at least a substantial portion of the tapered outer circumferential surface of the arbor, and an outer circumferential surface extending about at least a substantial portion of the circumference of the sleeve, the sleeve being adjustably movable relative to the arbor with the tapered inner circumferential surface forced against the tapered outer circumferential surface of the arbor for expanding a diametrical extent of the sleeve; and wherein the sleeve is a lapping sleeve configured to carry loose abrasives, the arbor further comprises an internal passage connecting with a passage through the sleeve configured for delivering a lapping compound comprising loose abrasives to the outer circumferential surface of the sleeve, and the tool comprises a reservoir adapted for holding a quantity of the lapping compound and a piston for applying a displacement or pressure to move the lapping compound into the internal passage.

2. The bore finishing tool of claim 1, wherein the sleeve further comprises a plurality of internal material relief features at circumferentially spaced locations in the tapered inner circumferential surface and extending radially outwardly therefrom partially through the sleeve, so as to reduce a level of force required for expanding the diametrical extent of the sleeve.

3. The bore finishing tool of claim 2, wherein the plurality of internal material relief features comprise flutes having curved radially inwardly facing surfaces.

4. The bore finishing tool of claim 3, wherein the flutes extend only partially along a length of the sleeve.

5. The bore finishing tool of claim 2, wherein the plurality of internal material relief features comprise fractures of the sleeve formed during manufacture of the sleeve.

6. The bore finishing tool of claim 1, wherein the outer circumferential surface of the sleeve is substantially cylindrical shaped.

7. The bore finishing tool of claim 1, wherein the arbor is mounted to a spindle of a lapping machine configured to apply the displacement or pressure to the piston.

8. The bore finishing tool of claim 7, wherein the lapping machine is configured to apply a controlled displacement or a controlled amount of pressure.

9. The bore finishing tool of claim 2, wherein the outer circumferential surface of the sleeve is substantially cylindrical shaped having a length, such that the sleeve has a tapered sectional shape along the length of the cylindrical shape, and the plurality of internal material relief features extend only partially the length of the tapered sectional shape.

10. The bore finishing tool of claim 1, wherein the sleeve comprises at least one retraction feature adjacent to a thicker-walled end thereof, configured for engagement by external apparatus for applying a retraction force against the sleeve for moving the sleeve relative to the arbor in a direction of convergence of the internal tapered surfaces, for reducing the diametrical extent of the sleeve.

11. The bore finishing tool of claim 10, wherein the retraction feature comprises at least one groove extending at least partially circumferentially about the sleeve and having a shape that enables receiving the external apparatus for applying the retraction force against the sleeve.

12. A bore finishing tool, comprising an arbor having a mounting end configured for mounting to a spindle of a bore finishing machine for rotation about an axis of rotation through the spindle, the arbor having a free end opposite the mounting end, and a tapered outer circumferential surface extending about the arbor between the mounting end and the free end;

a sleeve having a tapered inner circumferential surface cooperatively disposed about at least a substantial portion of the tapered outer circumferential surface of the arbor, in surface to surface contact therewith, and an outer circumferential surface extending about at least a substantial portion of the circumference of the sleeve, the sleeve being diametrically expandable by forced movement relative to the arbor, in a direction of divergence of the tapered outer surface;

the sleeve further including a plurality of internal flutes at circumferentially spaced locations in the tapered inner circumferential surface and extending radially outwardly therefrom partially through the sleeve for reducing a force required for the relative movement of the sleeve in the direction of divergence of the tapered outer surface; and wherein the sleeve is a lapping sleeve configured to carry loose abrasives, the arbor further comprises an internal passage connecting with a passage through the sleeve configured for delivering a lapping compound comprising loose abrasives to the outer circumferential surface of the sleeve, and the mounting end comprising a reservoir adapted for holding a quantity of the lapping compound and a piston for applying a displacement or pressure to move the lapping compound into the internal passage.

13. The bore finishing tool of claim 12, wherein the flutes extend only partially along a length of the sleeve in the direction of divergence.

14. The bore finishing tool of claim 12, wherein the reservoir comprises an open end on the mounting end of the arbor.

15. The bore finishing tool of claim 12, wherein the flutes comprise curved radially inwardly facing surfaces.

16. The bore finishing tool of claim 12, wherein the arbor is mounted to a spindle of a lapping machine configured to apply the displacement or pressure to the piston.

17. The bore finishing tool of claim 12, wherein the lapping machine is configured to apply a controlled displacement or a controlled amount of pressure.

18. The bore finishing tool of claim 12, wherein the sleeve comprises at least one retraction feature adjacent to a thicker-walled end thereof, configured for engagement by external apparatus for applying a retraction force against the sleeve for moving the sleeve relative to the arbor in a direction of convergence of the internal tapered surfaces, for reducing the diametrical extent of the sleeve.

19. The bore finishing tool of claim 18, wherein the retraction feature comprises at least one groove extending at least partially circumferentially about the sleeve and having a shape that enables receiving the external apparatus for applying the retraction force against the sleeve.

20. A lapping tool, comprising an arbor having a mounting end configured for mounting to a spindle of a bore finishing machine for rotation about an axis of rotation through the spindle, the arbor having a free end opposite the mounting end, and a tapered outer circumferential surface extending about the arbor between the mounting end and the free end;

a lapping sleeve having a tapered inner circumferential surface cooperatively disposed about at least a substantial portion of the tapered outer circumferential surface of the arbor, in surface to surface contact therewith, and an outer circumferential surface extending about at least a substantial portion of the circumference of the sleeve, the sleeve being diametrically expandable by forced movement relative to the arbor in a direction of divergence of the tapered outer surface; and wherein the arbor further comprises an internal passage connected to a passage through the sleeve configured for delivering a lapping compound to the outer circumferential surface of the sleeve, and the mounting end comprises a reservoir connected to the internal passage and adapted for holding a quantity of the lapping compound, and a piston disposed in an open end of the reservoir to apply a displacement or pressure to move the lapping compound into the internal passage.

21. The lapping tool of claim 20, wherein the lapping sleeve further comprises a plurality of internal flutes at circumferentially spaced locations in the tapered inner circumferential surface and extending radially outwardly therefrom partially through the sleeve for reducing a force required for the relative movement of the sleeve in the direction of divergence of the tapered outer surface.

22. The lapping tool of claim 20, wherein the flutes extend only partially along a length of the sleeve in the direction of divergence.

23. The lapping tool of claim 20, wherein the outer circumferential surface of the sleeve has a tapered lead in portion adjacent to the free end of the arbor.

24. The lapping tool of claim 20, wherein the sleeve comprises at least one retraction feature adjacent to a thicker-walled end thereof, configured for engagement by external apparatus for applying a retraction force against the sleeve for moving the sleeve relative to the arbor in a direction of convergence of the internal tapered surfaces, for reducing the diametrical extent of the sleeve.

25. The lapping tool of claim 24, wherein the retraction feature comprises at least one groove extending at least partially circumferentially about the sleeve and having a shape that enables receiving the external apparatus for applying the retraction force against the sleeve.

26. A bore finishing tool, comprising an arbor having a mounting end configured for mounting to a spindle of a bore finishing machine for rotation about an axis of rotation through the spindle, the arbor having a free end opposite the mounting end, and a tapered outer circumferential surface extending about the arbor between the mounting end and the free end;

a sleeve having a tapered inner circumferential surface cooperatively disposed about at least a substantial portion of the tapered outer circumferential surface of the arbor, in surface to surface contact therewith, and an outer circumferential surface extending about at least a substantial portion of the circumference of the sleeve, the sleeve being diametrically expandable by forced movement relative to the arbor, in a direction of divergence of the tapered outer surface;

wherein the sleeve comprises at least one retraction feature adjacent to a thicker-walled end thereof, configured for engagement by external apparatus for applying a retraction force against the sleeve for moving the sleeve relative to the arbor in a direction of convergence of the internal tapered surface, for retracting the diameter of the sleeve, and wherein the arbor further comprises an internal passage connected to a passage through the sleeve configured for delivering a lapping compound to the outer circumferential surface of the sleeve, and the mounting end comprises a reservoir connected to the internal passage and adapted for holding a quantity of the lapping compound, and a piston disposed in an open end of the reservoir to apply a displacement or pressure to move the lapping compound into the internal passage.

27. The tool of claim 26, wherein the retraction feature comprises at least one groove extending at least partially circumferentially about the sleeve and having a shape that enables receiving the external apparatus for applying the retraction force against the sleeve.

28. The tool of claim 26, wherein the sleeve further comprises internal flutes at circumferentially spaced locations in the tapered inner circumferential surface and extending radially outwardly therefrom partially through the sleeve for reducing a force required for the relative movement of the sleeve in the direction of divergence of the tapered outer surface.

* * * * *